US005403625A

United States Patent [19]

Legierse et al.

[11] Patent Number: 5,403,625

[45] Date of Patent: Apr. 4, 1995

[54] METHOD FOR THE ELECTROLESS DEPOSITION OF A MULTILAYER ON A FLAT ARTICLE FROM A METALLISATION LIQUID, A DEVICE FOR CARRYING OUT SAID METHOD AND A MASTER DISC OBTAINED ACCORDING TO THE METHOD

[75] Inventors: Petrus E. J. Legierse, Nuenen; Paulus G. J. de Boer, Best; Jacobus H. Baten, Geldrop, all of Netherlands

[73] Assignee: U.S. Philips & Du Pont Optical Company, New York, N.Y.

[21] Appl. No.: 111,038

[22] Filed: Aug. 24, 1993

Related U.S. Application Data

[63] Continuation of Ser. No. 960,212, Oct. 13, 1992, abandoned, which is a continuation of Ser. No. 651,897, Feb. 6, 1991, abandoned.

[30] Foreign Application Priority Data

Feb. 12, 1990 [NL] Netherlands ..... 9000323

[51] Int. Cl.[6] ..... C23C 26/00

[52] U.S. Cl. ..... 427/437; 427/8; 427/10; 427/241; 427/304; 427/305; 427/306; 427/425; 427/426; 427/443.1

[58] Field of Search ..... 427/304, 305, 306, 437, 427/443.1, 10, 426, 425, 241, 8

[56] References Cited

U.S. PATENT DOCUMENTS

| | | | |
|---|---|---|---|
| 3,073,719 | 1/1963 | Albright | 118/323 |
| 3,818,863 | 6/1974 | St Pierre | 118/323 |
| 3,821,016 | 6/1974 | De Angelo | 427/304 |
| 4,332,833 | 6/1982 | Aspnes | 427/8 |
| 4,416,213 | 11/1983 | Sakiya | 118/321 |
| 4,469,713 | 9/1984 | Schwiecker | 427/8 |
| 4,564,280 | 1/1986 | Fukuda | 118/321 |
| 4,814,198 | 3/1989 | Baeckland | 427/8 |
| 4,832,799 | 5/1989 | Knudsen | 427/306 |
| 4,857,367 | 8/1989 | Thorn | 118/323 |
| 4,864,966 | 9/1989 | Anderson | 118/323 |
| 4,894,260 | 1/1990 | Kumasaka | 427/241 |
| 4,931,147 | 6/1990 | Legierse | 204/30 |
| 5,141,778 | 8/1992 | Yarkosky | 427/304 |
| 5,238,702 | 8/1993 | Giesecko | 427/443.1 |

FOREIGN PATENT DOCUMENTS

| | | | |
|---|---|---|---|
| 738035 | 2/1970 | Belgium | 427/306 |
| 1058021 | 2/1967 | United Kingdom . | |
| 881080 | 11/1981 | U.S.S.R. | 118/323 |
| 9005795 | 5/1990 | WIPO | 118/323 |

*Primary Examiner*—Shrive Beck
*Assistant Examiner*—Vi Duong Dang
*Attorney, Agent, or Firm*—Norman N. Spain

[57] ABSTRACT

The method serves for the electroless deposition of a metal layer (7) from a metallization liquid on a top side of a flat article to be metallized, more in particular a flat disc, for example, a master disc (1) which is used for the reproduction of optical discs. According to the method the top side of the article is first made hydrophilic, if so necessary, after which, with the article supported in a horizontal position, a quantity of metallization liquid is provided on the top side which was previously made hydrophilic as a stable liquid layer (16) bounded by the edges of the article, after which the deposition of the metal from the liquid on the article takes place and the liquid layer is the removed entirely from the surface.

15 Claims, 3 Drawing Sheets

METHOD FOR THE ELECTROLESS DEPOSITION OF A MULTILAYER ON A FLAT ARTICLE FROM A METALLISATION LIQUID, A DEVICE FOR CARRYING OUT SAID METHOD AND A MASTER DISC OBTAINED ACCORDING TO THE METHOD

This is a continuation of application Ser. No. 07/960,212, filed Oct. 13, 1992, now abandoned, which is a continuation of application Ser. No. 07/651,897, filed Feb. 6, 1991, now abandoned.

BACKGROUND OF THE INVENTION

The invention relates to a method for the electroless deposition of a metal layer from a metallization liquid comprising a metal compound in solution on a flat side of an article to be metallised, for example, a flat disc, more in particular a master disc.

The invention also relates to a device for carrying out the method and a master disc obtained according to the method.

A method of manufacturing a metal matrix is described in U.S. Pat. No. 4,931,147 (=PHN 12 671, herewith incorporated by reference). A glass disc is provided with a photoresist layer in which an information track is provided. A nickel layer is provided on the master disc thus formed in an electroless nickel-plating bath. A further metal layer is provided on the nickel layer by electrodeposition, which metal layer is then separated from the master disc as a metal shell in which the information track of the photoresist layer is copied. The metal shell may then be used as a matrix for manufacturing optically readable discs. The method according to the invention is suitable for the electroless deposition of the nickel layer on the master disc, as well as the electroless deposition of the metal layer on other flat articles.

In this U.S. patent a master disc is disclosed which consists of a flat polished glass disc which on one side is provided with a layer of a usually positively acting photoresist. A suitable photoresist is, for example, a resist based on novolak and orthonaphthoquinone diazide. The photoresist layer is exposed in the form of a pattern, to, for example, modulated laser light. As a result of which the exposed parts become soluble in a basic solution of, for example, NaOH in water. In order to improve the bonding between the glass disc and the photoresist, a bonding layer is provided on the glass disc before the photoresist layer is provided. A suitable bonding layer is, for example, titanium acetyl acetonate. In order to obtain a readily bonding nickel layer, this U.S. Patent describes a number of measures. For example, before providing the nickel layer the top side of the master disc may be treated with a detergent and a solution of aminosilane. It is further suggested to provide the metallization liquid with sodium benzene disulphonate to reduce stresses in the deposited metal layer. After the treatment with aminosilane the top side of the master disc may be treated with tannin. This has a favourable effect on the bonding of the nickel layer. It is stated that the various types of liquids may be sprayed, atomized poured, etc. on the surface of the master disc and that dipping the master disc in the various solutions is also possible. Further data with respect to the electroless nickel-plating of master discs may be derived from this U.S. Patent.

It is known from GB-A 1,058,021 to silver-plate flat articles by spraying the article with liquids. A separate nozzle is used for each liquid, the various nozzles are united to form one assembly of movable spraying device which is controlled by means of suitable control means in such a manner that the nozzle to be used is always opposite to the article. The nozzles and also the article are in a closed metallization device. The article, for example, a master disc, is provided on a rotating spindle in an inclined position. As a result of the inclined position the sprayed liquid constantly flows off the disc. The uniformity of the sprayed liquid film is promoted by the rotation. So these measures together ensure a uniform film of constantly refreshed liquid to be created on the top side of the article.

The method known from the said GB-A 1,058,021 is not suitable for the electroless metallization of articles by means of a stable metallization liquid, for example, a stable nickel plating liquid. Nickel salts and reduction agent, for example, are present side by side in a stable nickel-plating liquid without reacting with each other. Only the presence of a catalyst at the surface of the article to be metallised leads to the deposition of metal from the liquid. For the deposition of nickel, for example, palladium may serve as a catalyst. When using stable metallization liquids the kinetics of the metallization plays an important part. The process of depositing metal on a surface from a stable metallization liquid, for example, a nickel-plating liquid comprising nickel sulphate complexed with pyrophosphate and ammonium, is kinetically and thermodynamically limited. This means that a minimum temperature is necessary and that movement of the metallization liquid should be limited to such an extent that the deposition of metal is not prevented or inhibited by excessive kinetic supply of ions (hydrogen ions). The method of this British Patent Specification is excellently intended for use of a non-kinetically limited metallization. Furthermore a disadvantage of the known method is the considerable consumption of process liquids. The liquids at the surface of the article are constantly refreshed, which in a non-kinetically limited metallization, leads to a rapid metallization. However, it does have for its result that the liquids used are used effectively only partly.

SUMMARY OF THE INVENTION

It is an object of the invention to provide a method which is excellently suitable for the electroless metallization of master discs manufactured according to the method disclosed in the U.S. patent mentioned hereinbefore but which might also be used advantageously for the metallization of other articles.

It is a further object of the invention to provide a method with which a more economic use of process liquids is possible and which in addition is excellently suitable for use of stable metallization liquids.

The method according to the invention is characterized in that the side to be metallised of the article is made hydrophilic, the article is supported with that the hydrophilic side directed upwards, and in an at least substantially horizontal position, the hydrophilic side is made catalytic for electroless deposition, a quantity of metallization liquid is deposited on the hydrophilic side of the article side and assumes the shape of a layer of a substantially constant thickness bounded by edges of the article, and is kept for some time in a substantially stationary condition, and after the deposition of a metal layer of a sufficient thickness the remaining metallization liquid is removed.

DETAILED DESCRIPTION OF THE INVENTION

Figure 1:
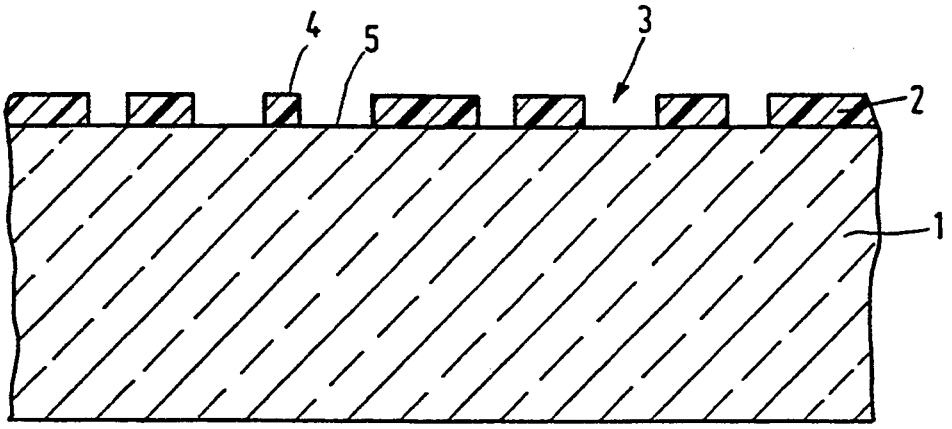
FIG. 1 is a diagrammatic cross-sectional view of a part of an article to be metallized consisting of a master disc.

The invention surprisingly uses the fact that it is possible to give an article such a surface treatment that it is possible to provide a stable layer of liquid of some millimeters thickness on the surface. Thus in the method according to the invention an adjusted, comparatively small quantity of fresh metallization liquid is always used which, after having been provided on the surface of the article, remains there in a stationary condition for some time. During this time metal deposits on the surface of the article. The invention thus combines uniquely the property of methods as described in the GB-A 1,058,021 mentioned hereinbefore in which an adjusted quantity of metallized liquid is used with the fact that the metallization liquid remains in a stationary situation in contact with the surface to be metallized, as is done, for example, also in a dipping bath. Compared with methods according to the British Patent Specification less metallization liquid is necessary and a stable metallization liquid may be used and, compared with the use of a dipping bath, the advantage is present that each article is always metallization using fresh metallized liquid with all the resulting advantages. For example, degradation of the store of the metallization liquid does not occur. When stable metallization liquids are used the store of metallization liquid keeps its stable character since poisoning by catalyst is avoided. The metal can be used very flexibly since it does not constitute any objection to stop the metallization of further articles after completing the metallization of one article.

In order to ensure that the metallization liquid during the metallization is in contact with the top side of the article, to be metallized it is necessary that a hydrophilic surface is present, that is to say a surface which comprises sufficient hydroxyl groups. It has been found that master discs immediately after the development of the photoresist layer can be further used without any separate treatment for making the photoresist layer hydrophilic being necessary for the initial metallization. It has also been found, however, that after storing the developed master discs for some time the photoresist layer becomes water-repellent in such a manner so that before the metallization liquid can be provided on the surface, a pretreatment is necessary for making the surface hydrophilic. The above-mentioned U.S. Pat. No. 4,931,147 describes a few suitable manners of making the surface hydrophilic.

Experience has demonstrated that according to an embodiment of the invention the thickness of the layer off metallization liquid should be between 0.5 and 5 mm. When the thickness of the layer of metallization liquid is smaller, problems occur in the formation of a metal layer of a sufficient thickness and of a sufficient homogeneity. A stationary layer of metallization liquid having a thickness of more than 5 mm is difficult to obtain. It has been found that good results can be obtained when according to an embodiment of the invention the thickness of the layer of metallization liquid is between 3 and 4 mm, for example 3.5 mm.

With a view to accelerating the metallization process, an embodiment of the invention is of importance which is characterized in that before the metallization liquid is deposited on the article, both the metallization liquid and the article are heated above room temperature. Of great importance is the embodiment which is characterized in that a quantity of metallization liquid is always heated which is just sufficient for metallizing a single article. As a result of this it is prevented that unnecessary degradation of the store of metallization liquid occurs. Still a further embodiment of the invention may be used advantageously which is characterized in that the article is heated to a higher temperature than the metallization liquid and the combination of article and metallization liquid after the deposition of the metallization liquid assumes a temperature which has an optimum value for the metallization process. For example, according to an embodiment of the invention which is of particular interest for nickel-plating articles by means of a stable nickel-plating liquid, the article is heated with water of 57° C. and the metallization liquid is heated to a temperature of 51° C.

The metallization may take a number of minutes, for example, 5 minutes. It is of importance that during this period of time the layer of metallization liquid remains present on the surface in a substantially stationary condition and that the temperature thereof does not change much. In order to be able to perform the metallization in accurately controllable conditions, an embodiment of the invention is of importance which is characterized in that the method is carried out within a housing in which an air flow is maintained at a controlled temperature and a controlled speed and the temperature of the layer of metallization liquid at the end of the metallization is still above the temperature at which the deposition of metal from the metallization liquid stops. Furthermore, the speed of the air flow should be so low that no interference of the stationary condition of the layer of metallization liquid occurs. For reducing evaporation of metallization liquid and the resulting cooling, according to a further embodiment of the invention water vapor may be added to the air flow.

A method according to the invention which is extremely advantageous is characterized in that the article is supported so as to be rotatable and is slowly rotated during the metallization. Slow rotation is to be understood to mean in this connection such a low speed of rotation that no essential influence is exerted on the stationary condition of the metallization layer. However, as a result of the slow rotation a few important advantages are obtained. First of all, an equalization of the temperature distribution in the layer of metallization liquid occurs. Further it is prevented that as a result of the inevitable remaining small extent of inclined position of the article, and the resulting non-uniform thickness of the layer of metallization liquid, a metal layer is formed on the surface of the article having an inhomogeneous thickness and composition. As a result of the rotating support of the article a series of further advantages are obtained. For example, a uniform coating of the top side of the article is possible, by depositing, in accordance with an embodiment of the invention, the metallization liquid on the article from one or more outflow apertures with simultaneous slow rotation of the article. Slow rotation is to be understood to mean herein a rotation having such a low speed that the deposited metallization liquid is not flung from the article. It has proved to be important to use during the metallization an embodiment of the invention which is characterized in that the article is rotated uniformly at a speed which is a fraction of 1 Hz. The speed preferably is approximately 1/40 Hz.

Further advantages are possible in an embodiment of the invention which is characterized in that, after termination of the metallization step, the metallization liquid is removed from the surface of the article by increasing the speed of rotation and the resulting flinging away of the metallization liquid under the influence of centrifugal forces. Further the characteristic feature may be used that in addition to the metallization step, the method comprises a number of preceding steps in which liquid is provided on the top side of the article and is removed therefrom, for example, for providing layers of solutions of silane, tannin, salts of tin, silver and palladium and the intermediate rinsing with demineralised water and that during these further steps the article is also supported and rotated horizontally.

Since in the method according to the invention a substantially stationary layer of metallization liquid is present on the top side of the article to be metallized, an embodiment may advantageously be used to increase the controllability of the method used, which is characterized in that the thickness of the deposited metal layer is measured by optical means by means of a beam of radiation in a wavelength for which the metallization liquid is transparent. In principle, a measurement in reflection or in transmission may be used in known manner. However, measuring is always done through the layer of metallization liquid. When measuring in transmission, measuring is also done through the article so that in that case also the article should be transparent for the beam of radiation used. When this embodiment of the invention is used, the metallization may be discontinued at the exact instant at which the provided metal layer has the desired reflective or transmissive properties. In this manner a very constant product of the provided metal layers may be ensured and too long metallization times are prevented.

The invention not only relates to the method described, but also relates to devices which are suitable for carrying out the method. It has been found that such a device is preferably characterized in that the device comprises a movable spraying member comprising at least one outflow aperture for each type of liquid to be used and that the spraying member is movable between a spraying position above the article and a rest position on the side of the article. By using a separate spraying aperture for each liquid to be used, an undesired mixing of liquid is avoided. Undesired dripping of the liquids on the top side of the article to be metallized is prevented by moving the spraying arm aside in the rest condition.

The invention will now be described in greater detail with reference to the drawing which shows an embodiment of the invention by way of example.

Reference numeral 1 in FIG. 1 denotes a 5 mm thick glass disc having a diameter of 240 mm. The glass disc is provided on one side with a bonding layer of titanium acetyl acetonate (not shown). The bonding layer is provided by means of a 0.5% solution of a titanium acetyl acetonate-isopropanol mixture in methyl isobutyl ketone, after which the solvent is evaporated. A photoresist layer 2 is then provided on the bonding layer and after drying has a layer thickness of, for example, 0.12 μm. The positive photoresist used is a novolak having orthonaphthoquinone diazide as a photosensitive material. The resist layer is exposed to pulsated laser light (wavelength 458 nm) which is modulated in accordance with the information to be recorded. The resist layer thus exposed in a form of a pattern is developed with a solution of 10 g of NaOH and 50.5 g of $Na_4P_2O_7.10H_2O$ per 4.5 liter of water. As a result of this the exposed parts of the photoresist layer are dissolved and a spiral-like information track 3 is formed which has a crennelated profile of information areas 4 situated at a higher level alternated by information areas 5 situated at a lower level. The longitudinal dimensions of the areas vary from approximately 0.3 to 3 μm in accordance with the stored information. The difference in height between the information areas is approximately 0.1 μm. The master disc is then dipped in a solution of 0.1 g of sodium lauryl sulphate per liter of water for 5 minutes. Rinsing with deionised water is then done for 1 minute. Process solutions of the following compositions are prepared for the treatments mentioned hereinafter:

Aminosilane solution: 4 ml of an aminosilane solution sold as silane A1120 (product of Union Carbide Corp.) is dissolved per 400 ml of deionised water.

Tannin solution: 1.2 g of tannin dissolved per 400 ml of deionised water.

$Sn^{2+}$ solution: 5 μl of an $S^{2+}$ solution sold as an RNA solution (product of London Laboratories Ltd.) is dissolved per 400 ml of deionized water.

The master disc is provided in the following sequence on the photoresist side with the above mentioned process solutions by means of the method according to the invention, in which rinsing with deionized water is carried out for 1 minute after each process step.

| | |
|---|---|
| Aminosilane solution | 3 minutes |
| Tannin solution | 1 minute |
| $Sn^{2+}$ solution | 1.5 minutes |
| $Ag^{+}$ solution | 1 minute |
| 0.5 ml of an $Ag^{+}$ solution sold as an MS-IO solution is dissolved in 400mn deionized water. | |
| $Pd^{2+}$ solution | 1.25 minutes. |
| (100 mg $PdCl_2$ dissolved in 3.5 ml conc. hydrochloric acid; made up to 1 litre with deionised water). | |

The master disc pretreated in this manner is then electrolessly nickel-plated. For that purpose solutions of the following compositions are prepared:

| | |
|---|---|
| Stock solution A: $NiSO_4.6H_2O$ | 50 g |
| $Na_4P_2O_7.10H_2O$ | 100 g |
| per litre of deionized water. | |

The solution is brought at a pH of 9.4 by means of concentrated ammonia.

Stock solution B: dimethylaminoborane 3 g per liter of deionized water.

Equal volumes of stock solutions A and B are combined. The resultant solution is brought at a pH of 9.2 by means of an aqueous $H_2SO_4$ solution (50% by weight of $H_2SO_4$). 1.110 g of sodium benzene disulphonate per 2 liter are then dissolved in the said solution. The nickel plating liquid is then ready.

Figure 2:
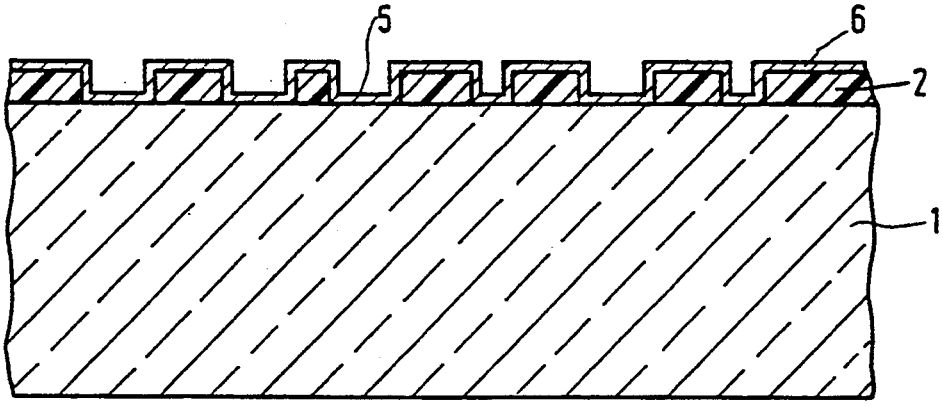
FIG. 2 is a diagrammatic cross-sectional view of a part of a master disc comprising an electroless-deposited nickel layer.

An adjusted quantity of 400 ml of the nickel-plating liquid is heated at 51° C. and brought on the photoresist side of the pretreated master disc. After approximately 30 minutes a 100 nm thick Ni layer 6 (see FIG. 2) has been deposited on the photoresist layer 2 and on the glass surface 3. The Ni layer comprises a few per cent by weight of B originating from the reduction agent dimethylaminoborane.

Figure 3:
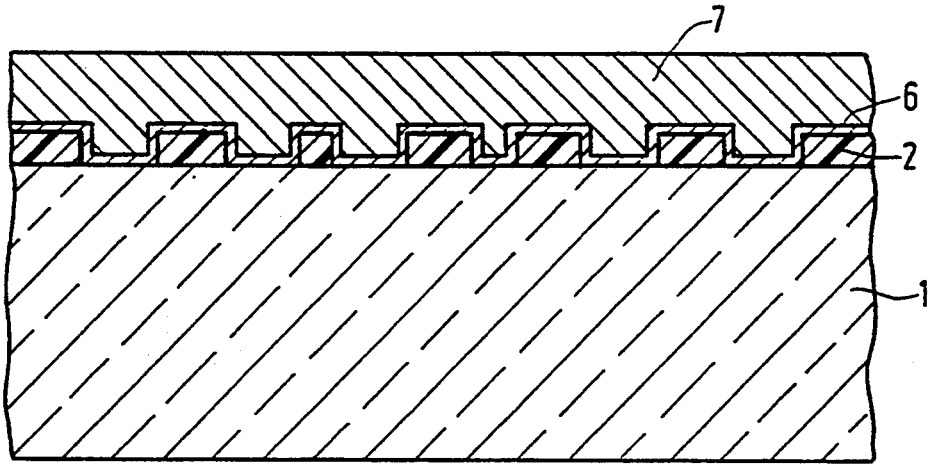
FIG. 3 is a diagrammatic cross-sectional view of a part of a master disc comprising an electroless-deposited nickel layer and a electrolytically grown metal layer.

A nickel layer 7 (see FIG. 3) is then grown electrolytically in a thickness of 300 μm on Ni layer 6. The electroless Ni layer is connected as cathode in a bath having, for example, the following composition:

| | |
|---|---|
| Nickel sulphamate | 450 g/l |
| $NiCl_2.2H_2O$ | 5 g/l |
| Boric acid | 45 g/l. |

The temperature of the bath of 45° C. and the pH has a value of 4.0. The Ni layer is deposited at a current density of approximately 15 A/dm$^2$.

Figure 4:
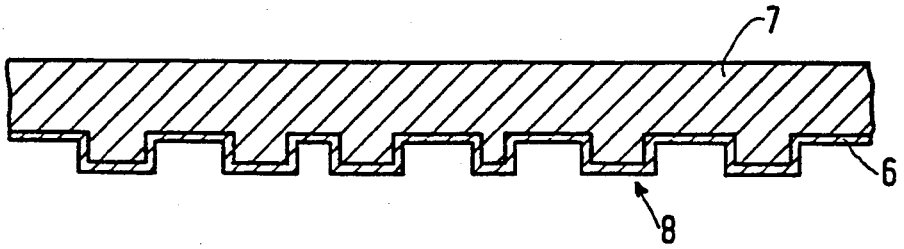
FIG. 4 is a diagrammatic cross-sectional view of a part of a father matrix.

The metal shell consisting of the Ni layer 7 and the electroless Ni layer 6 bonded thereto is pulled loose from the photoresist layer 2 (see FIG. 4). The information track 8 present in the metal shell is a negative copy of information track 1 (FIG. 1). This negative copy is the father matrix. Any remains of the photoresist layer remaining on the father matrix can be removed by means of the developing solution already mentioned, if the photoresist layer after developing the parts exposed in the form of a pattern is fully exposed with, for example, a 500 W super high pressure Hg lamp for 4 minutes. Usually a metal copy (mother matrix) is manufactured from the father matrix by passivating the surface of the nickel layer by treatment of the aqueous solution of $K_2Cr_2O_7$ and then growing an Ni layer on the side of the information track 8 by electroplating. After separating the latter Ni layer from Ni layer 6, 7 the mother matrix is obtained. Son matrices can be manufactured from said mother matrix in the same manner as mentioned hereinbefore by electroplating. By means of the son matrix, synthetic resin information carriers are manufactured by using, for example, an injection moulding process. Both the father matrix, the mother matrix, the son matrix and the synthetic resin information carriers have excellent surface qualities.

Figure 5:
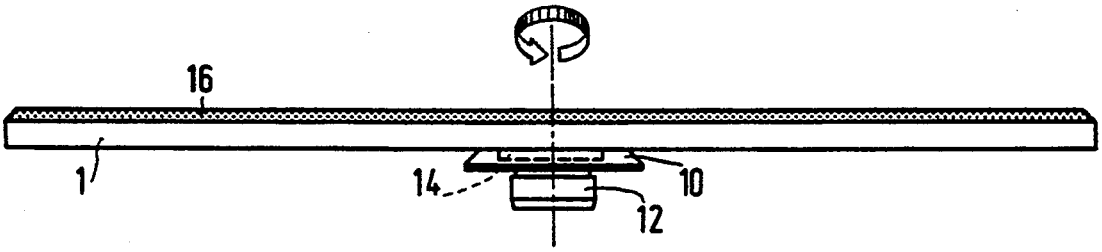
FIG. 5 is a side elevation of a master disc having a liquid layer provided thereon and a turntable with motor to support the master disc.

As shown in FIG. 5, for nickel-plating, the glass substrate 1 of the master disc having thereon the resist layer 2 comprising an information track 3 (not shown in the drawing) is supported in a horizontal position with the top side directed upwards. The horizontal support is obtained by means of a turntable 10 which is driven by an electric motor 12. The glass substrate 1 has no central aperture. On the lower side a ferromagnetic centering head 14 is adhered which is held by the turntable 10 by means of permanent magnetic clamping means in a manner which is not shown but which is known per se. A quantity of nickel-plating liquid is deposited on the top side of the glass substrate and assumes the shape of a layer 16 of a substantially constant thickness bounded by the outer edge of the substrate. This layer of approximately 3.5 mm thickness remains on the substrate in a substantially stationary condition until a nickel layer 6, see FIG. 2, of sufficient thickness has been deposited. The layer of nickel-plating liquid 16 is then removed entirely from the substrate 1. A stable layer of liquid can also be obtained when a glass plate is used which does have a central aperture.

Figure 6:
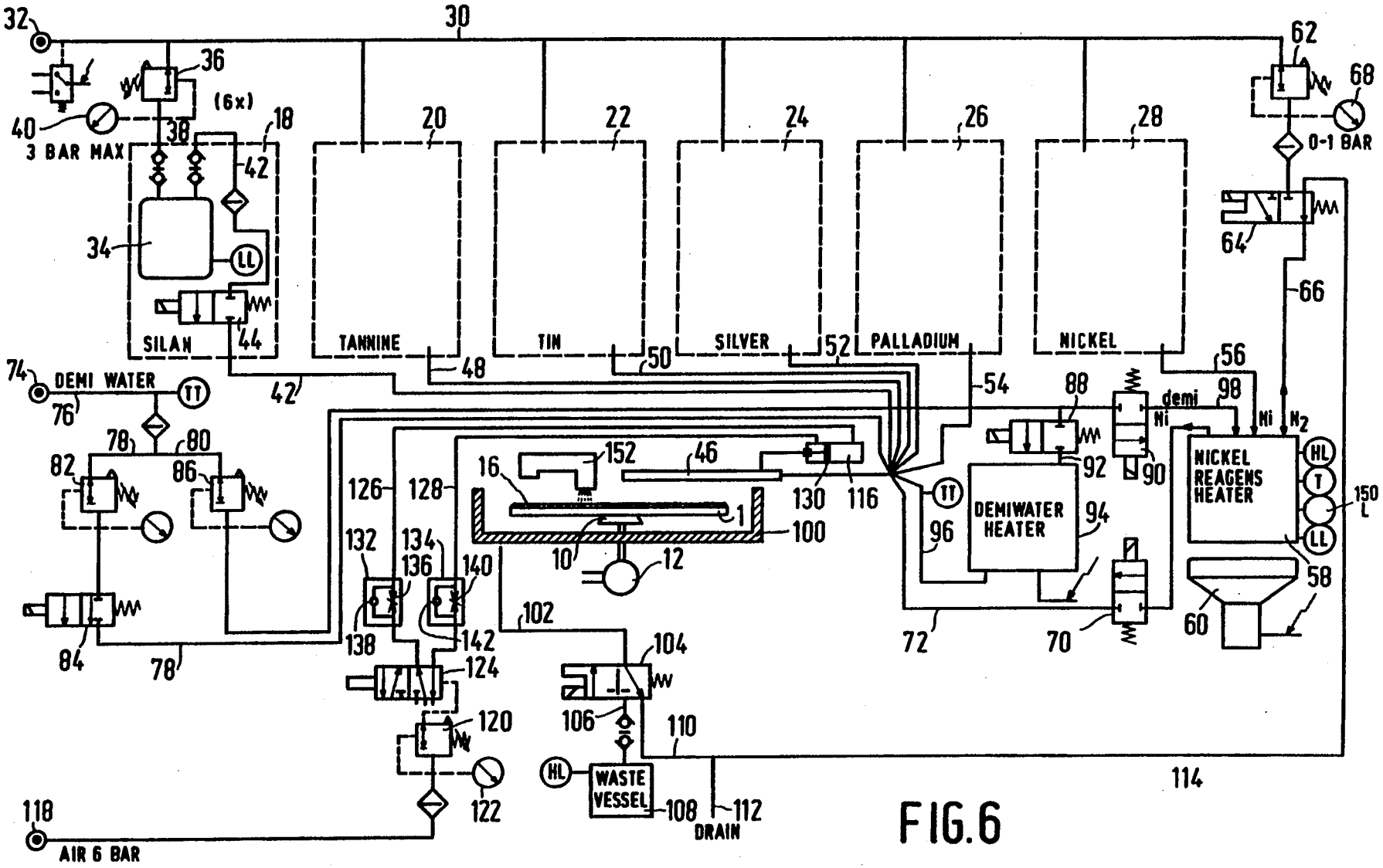
FIG. 6 is a diagram of a nickel-plating device.

The turntable 10 and the electric motor 12 form part of a nickel-plating device which is shown diagrammatically in FIG. 6. The device comprises a number of storage vessels 18 to 28, which comprise successively process liquids for treating the surface of the master disc with silane, tannin, tin, silver, palladium and then nickel. A compressed gas pipe 30 communicates with a compressed gas source not shown via a connection point 32. An inert gas, for example, nitrogen is preferably used. The storage container 18 comprises storage vessel 34 in which the silane-containing process liquid is present. Via a reducing valve 36 compressed gas is supplied to the contents of the storage vessel 34 via the pipe 38 at a pressure of approximate 3 bar to be read on a nanometer 40. The compressed process liquid is transported to the spray arm 46 via a duct 42 and an electromagnetic valve 44 incorporated therein. The storage containers 20 to 28 have similar provisions but these are not shown to avoid complexity of the drawing. Via the ducts 48 to 54 the storage containers 20 to 26 communicate with the spray arm 46. The outlet duct 56 of the storage container 28 of the nickel-plating liquid leads to an intermediate vessel 58 (nickel reagent heater) in which a certain quantity of nickel-plating liquid can be heated. Heating is done by means of an infrared radiator 60. The liquid heater 58 is under a pressure of approximately 1 bar via a reducing valve 62 and an electromagnetic valve 64 via a duct 66 to be read on a manometer 68. Heated nickel-plating liquid is supplied to the spray arm 46 via an electromagnetic valve 70 in a pipe 72. For rinsing the master disc demineralised water from a source not shown is supplied to the device Via a connection 74. The connection 74 communicates with a dividing pipe 76 which splits into two pipes 78 and 80. Demineralised water is supplied to the spray arm 46 under pressure after passing a pressure reducing valve 82 and an electromagnetically operated valve 84. The pipe 80 supplies demineralised water under pressure, via a pressure control valve 86, to two electromagnetic valves 88 and 90. The valve 88 communicates, via a pipe 92, with a water heating reservoir 94 which can supply heated demineralised water to the spray arm 46 via an outlet 96. The electromagnetic valve 90 supplies demineralised water to the nickel reagent heater 58 via a duct 98. As a result of this the liquid heater 58 can be rinsed with demineralised water at the end of the nickel-plating phase. The rinsing water is supplied to the spray arm 46 via the valve 70 and the duct 72 so that the water which is used for rinsing the nickel reagent heater 58 is also used for rinsing the surface of the master disc 1. During the rinsing the ducts between the liquid heater and the spray arm 46 are also rinsed.

During the process the master disc is accommodated in a container 100 which serves to collect processed used liquids. Draining used process liquids take place via a drain 102 which can be communicated with a waste reservoir 108 by means of an electromagnetically operated valve 104 via a duct 106 or can be communicated directly with a drain 112 via a duct 110. The waste reservoir 108 serves in particular to collect used process liquids which might be detrimental to the environment and/or of used liquids which can be processed in a cost-effective manner for recovering raw materials. For rinsing the liquid heater 58 with demineralised water, the duct 66 may also be used which may be communicated with the drain 112 via the electromagnetic valve 64 and via a drain 114.

Figure 7:
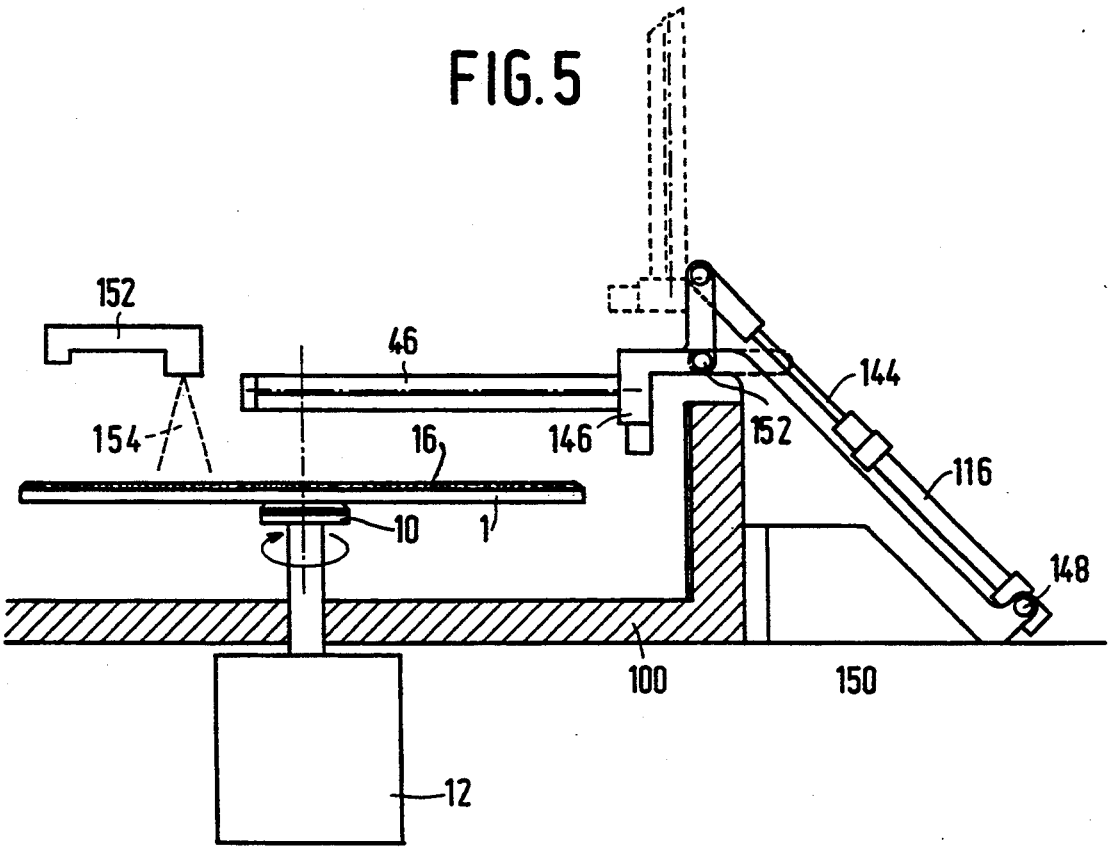
FIG. 7 is a part of the diagram of FIG. 6 on an enlarged scale.

The spray arm 46 can be moved between the spray positions above the master disc 1 shown and a rest position not shown on the side of the article by means of a pneumatic motor 116. In the rest position not shown the spray arm is in a vertical position, see also FIG. 7. Compressed air from a pressure reservoir not shown is used for driving the pneumatic motor via an air connection 118. The pressure is reduced to an operating pressure which is suitable for the motor 116 by means of a reducing valve 120 and can be read on a manometer 122. By means of an electromagnetically operated valve 124 the air of reduced pressure may be supplied via two ducts 126 and 128 optionally to one of the two sides of a piston 130 of the air motor 116 in order to move the piston in one or in the other direction. For restricting the rate of movement of the piston 130 control units 132 and 134 are incorporated in the ducts 126 and 128. The control unit 132 comprises an adjustable pneumatic resistor 136 and a pneumatic or non-return valve 138 arranged parallel thereto. The unit 134 comprises identical elements 140 and 142. Air supply to the pneumatic motor 116 may be done without hindrance via the pneumatic diode (non-return value 138) while the drain of air takes place via a pneumatic resistor as a result of which a braking of the movement of the piston occurs. As shown in greater detail in FIG. 7 the pneumatic motor 116 comprises a piston rod 144 which is connected at one free end to an approximately Z-shaped support 146 of the spray arm 46. On the oppositely located side the pneumatic motor is connected to a support 150 of the device so as to be swingable via a hinge 148. The Z-shaped support is connected to the device so as to be swingable by means of a hinge 152. By a translating movement of the piston rod 144 the spray arm 46 can thus be moved between the spray position above the master disc 1 shown and the broken line rest position on the side of the master disc. In the rest position any drops originating from the spray arm may be collected in the container 100.

The thickness of a deposited nickel layer on the master disc 1 is measured by means of optical means shown diagrammatically in the drawing, namely an optical reflection meter 152. This measures the extent of reflection of the deposited metal layer by means of a beam of radiation 154 having a wavelength for which the metallization liquid 16 is transparent. Since the construction of the reflection meter is not of importance for the essence of the present invention the operation thereof will not be further described. Such reflection meters, however, are known in the art. They comprise a radiation-sensitive cell which provides a voltage which is proportional to the intensity of the radiation incident on the cell. According as the thickness of the nickel layer increases, the reflecting power of the deposited nickel layer also increases and hence also the extent to which the radiation of the radiation beam 154 is reflected. So the intensity of the radiation incident on the radiation-sensitive cell also increases with the thickness of the nickel layer. At the instant the intensity of the reflected radiation has reached a previously adjusted value, the nickel-plating phase is terminated by an electronic control device not shown.

The receiving container 100 as well as a few other parts of the device shown in FIG. 6, for example, the liquid heater 58 and the infrared radiator 60, are present in a housing not shown in the drawing in which an air flow is maintained at a controlled temperature and a controlled speed by means known for air treating devices.

We claim:

1. A method for electroless deposition of a metal layer from a metallization liquid on a flat side of an article to be metallized more in particular a master disc, characterized that the side to be metallized is hydrophilic, the article is positioned with the hydrophilic side directed upwardly, in an at least substantially horizontal position, the hydrophilic side is made catalytic for electroless deposition, the article is supported so as to be rotatable, a quantity of metallization liquid is deposited on the hydrophilic side of the article in a manner such that during deposition the metallization liquid deposited on the said hydrophilic side assumes the shape of a layer of substantially constant thickness bounded by the edges of said article while said article is slowly rotated at a speed so as to maintain said layer in a substantially stationary position until a metal layer of sufficient thickness is deposited and then the remaining metallization liquid is removed.

2. A method as claimed in claim 1, characterized in that the thickness of the layer of metallization liquid is chosen between 0.5 and 5 mm.

3. A method as claimed in claim 2, characterized in that the thickness of the layer of metallization liquid is chosen between 3 and 4 mm.

4. A method as claimed in claim 1, characterized in that before depositing the metallization liquid on the article, both the metallization liquid and the article are heated above room temperature.

5. A method as claimed in claim 4, characterized in that a quantity of metallization liquid which is just sufficient for metallizing a single article is heated.

6. A method as claimed in claim 4, characterized in that the article is heated to a higher temperature than the metallization liquid in order that the combination of article and metallization liquid after depositing the metallization liquid assumes a temperature which has an optimum value for the metallization process.

7. A method as claimed in claim 6, characterized in that the article is heated to 57° C. and the metallization liquid is heated to a temperature of 51° C.

8. A method as claimed in claim 4, characterized in that the method is carried out within a housing in which an air flow is maintained at a controlled temperature and a controlled speed and the temperature of the layer of metallization liquid at the end of the metallization step remains above the temperature at which the deposition of metal from the metallization liquid stops.

9. A method as claimed in claim 8, characterized in that water vapor is added to the air flow to reduce evaporation of metallization liquid.

10. A method as claimed in claim 1, characterized in that the metallization liquid is deposited on the article from one or more outflow apertures with simultaneous slow rotation of the article.

11. A method as claimed in claim 1, characterized in that during the deposition of the metal the article is rotated uniformly at a speed which is a fraction of 1 Hz and such that said layer is maintained in said substantially stationary position.

12. A method as claimed in claim 11, characterized in that the speed is approximately 1/40 Hz.

13. A method as claimed in claim 1, 10, 11 or 12, characterized in that after completing the metallization step, the remaining metallization liquid is removed from the surface of the article by increasing the speed of rotation sufficiently to fling away said remaining metallization liquid under the influence of centrifugal forces.

14. A method as claimed in any of the preceding claims, characterized in that, preceding the metallization step, the method comprises a number of other steps in which liquids are provided on and removed from the side of the article to be metallized in particular solutions of silane, tannin, salts of tin, silver, palladium, and there is an intermediate rinsing with demineralised water and that the article is supported in a horizontal position and rotated also during said other steps.

15. A method as claimed in claim 1, characterized in that the thickness of the deposited metal layer is mesured by optical means by means of a beam of radiation having a wavelength for which the metallisatin liquid is transparent.

* * * * *